US006373012B1

(12) United States Patent
Crutchfield et al.

(10) Patent No.: US 6,373,012 B1
(45) Date of Patent: Apr. 16, 2002

(54) METHOD AND APPARATUS FOR FACILITATING CUSTOM SORTING OF MAIL ITEMS AND IMPROVED SEARCH TECHNIQUES USABLE THEREWITH

(75) Inventors: Christopher L. Crutchfield, Tulsa; William Wheeler, Sand Springs, both of OK (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/663,113

(22) Filed: Sep. 15, 2000

(51) Int. Cl.[7] ..... B07C 5/00
(52) U.S. Cl. ..... 209/584; 209/900; 707/200
(58) Field of Search ..... 209/584, 900; 707/200; 700/223, 224

(56) References Cited

U.S. PATENT DOCUMENTS 3,815,083 A * 6/1974 Dirks et al. ..... 340/172.5
4,677,550 A * 6/1987 Ferguson ..... 364/300
4,800,506 A * 1/1989 Axelrod et al. ..... 364/478
4,868,570 A * 9/1989 Davis ..... 341/106
5,042,667 A * 8/1991 Keough ..... 209/3.1
5,930,805 A * 7/1999 Marquis ..... 707/201
6,107,589 A * 8/2000 Yamashita et al. ..... 209/584

* cited by examiner

*Primary Examiner*—Donald P. Walsh
*Assistant Examiner*—Mark J. Beauchaine
(74) *Attorney, Agent, or Firm*—Wolf, Greenfield & Sacks, P.C.

(57) ABSTRACT

A method and apparatus are provided for custom sorting, outsorting and remapping mail items by utilizing a processor to compare postal codes read from incoming mail items, M characters at a time, with entries in a stored listing of entries, taking a first action if no match is found for an incoming entry and taking a second action if a match is found for the entry. Appropriate actions may include sending an entry unaltered to a sort processor or sending a directed value to the sort processor which may result in a remapping or outsorting of the mail item. A count may also be stored with each entry in the table, which count can be incremented or decremented when there is a match on such entry, and this count may be used to selectively control the sorting operation. Finally, the entries stored in the list may be converted to ordered entries and then stored as a digital tree, incoming entries also being converted to ordered entries on a character-by-character basis as received, and the entries in the tree being matched on, M characters at a time, as received. At least selected nodes of the tree contain output information so that the search may be terminated after any input character while still obtaining useful output information.

67 Claims, 4 Drawing Sheets

Figure 2C:
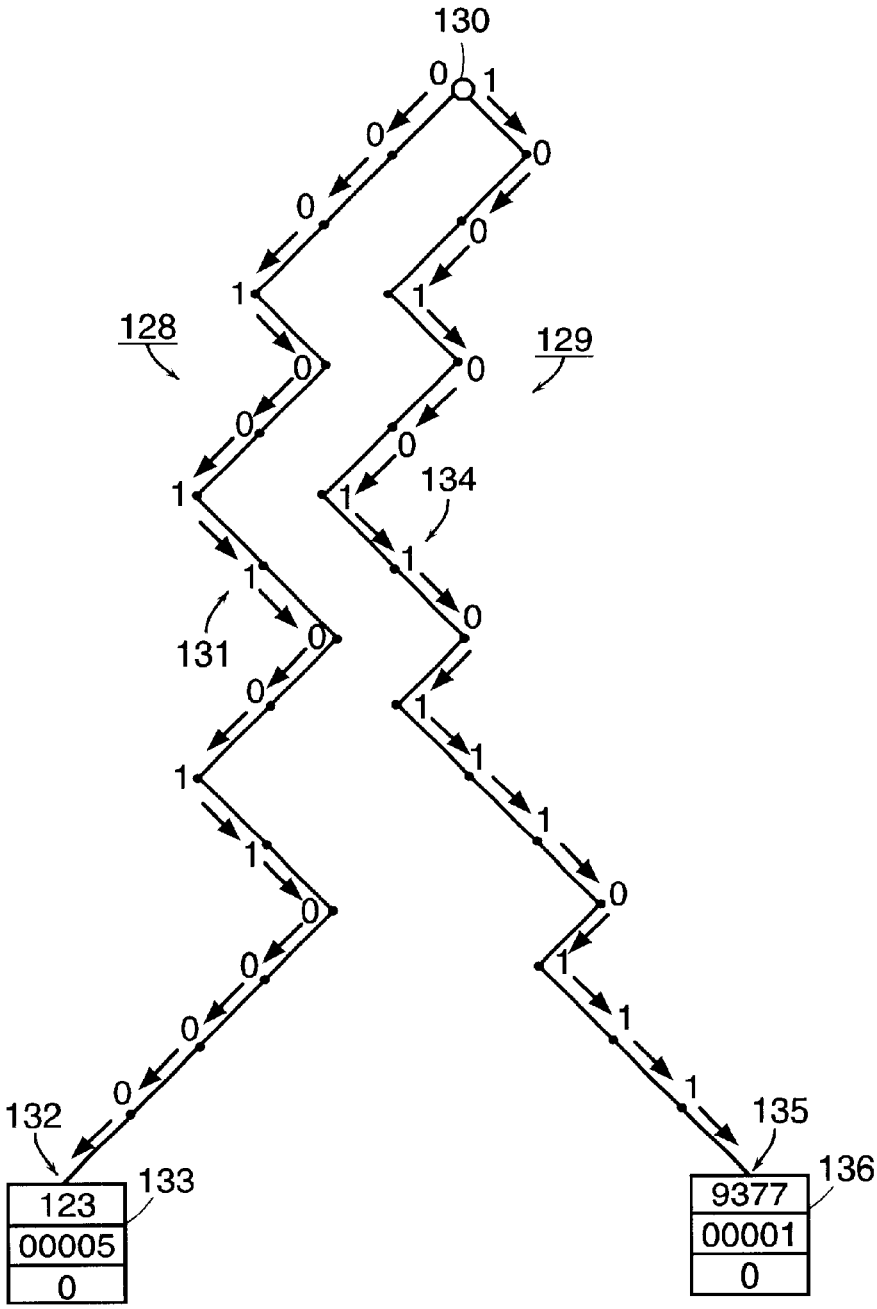

| INPUT DATA | OUTPUT DATA | COUNT VALUE |
|---|---|---|
| 123 | 00005 | 0 |
106 113 114
FIG. 2A
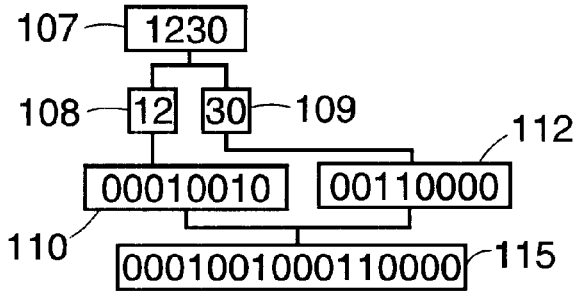
FIG. 2B
| INPUT DATA | OUTPUT DATA | COUNT VALUE |
|---|---|---|
| 9377 | 00001 | 0 |
106' 113' 114'
FIG. 2D
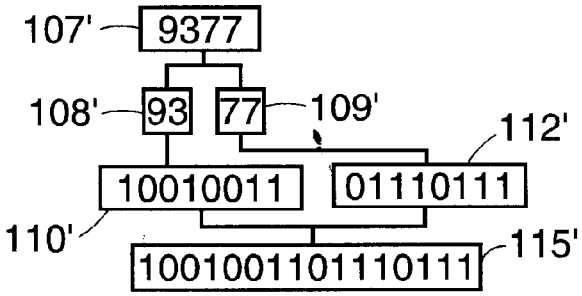
FIG. 2E

METHOD AND APPARATUS FOR FACILITATING CUSTOM SORTING OF MAIL ITEMS AND IMPROVED SEARCH TECHNIQUES USABLE THEREWITH

FIELD OF THE INVENTION

This invention relates to systems for sorting mail items and to related techniques for generating ordered lists and searching on such lists. More particularly, the invention relates to method and apparatus which facilitates selective outsorting or other selective custom remapping or sorting of mail items contained in a mass mailing, including improved search techniques usable therewith.

BACKGROUND OF THE INVENTION

Many organizations perform mass mailings of post cards, letters, catalogs, magazines, packages or other mail items on a daily basis. Such mailings can frequently exceed a million items per day. However, for many such mailings, there are a significant percentage of items which need not be sent, and in some instances should not be sent. For example, many such mailings include notices that a subscription, insurance policy or the like is about to be cancelled or has been cancelled for nonpayment of a renewal fee, premium or the like or other dunning letter for nonpayment of amounts due. Since there is normally a delay of several days, for example three to five days, between the time action is taken to initiate the sending of such a letter and the time the letter is actually mailed, in a significant percentage of cases, perhaps 3–10 percent of the cases depending on the industry, payment has been received before the letter actually goes out. Since there is a cost of approximately 25 cents in postage alone for the sending of such a letter, and the receipt of such a letter can engender bad will on the part of the recipient and cost the sender additional money in customer relations personnel having to deal with a concerned or irate customer, it is desirable to purge such notices from a mailing. However, a system for quickly and easily performing such a purge does not currently exist.

Similarly, a potential problem for a charity, catalog company or other company doing a mass mailing for solicitation, advertising or related purposes to recipients whose names have been obtained from a variety of mailing lists, is that multiple items are frequently sent to the same recipient. The mailer may be unaware of the problem since a recipient may appear as John Doe on one list, J. Doe on a second list, Mr. and Mrs. John Doe on a third list, John and Jane Doe on a fourth list, etc. Such multiple mailings to a single recipient are undesirable both because of the cost, both postage costs and the cost of the catalog or other material being sent, and because receiving multiple copies of the same mailing is annoying to the recipient and reflects badly on the organization and competence of the sender. Therefore, it would be desirable if such multiple copies could be purged so that a given recipient receives only one, or at most two, copies of the mailing. However, a technique for easily and inexpensively accomplishing this objective does not currently exist.

Other situations also exist where some type of custom purge, custom sorting and/or remapping is desirable on a given mailing. For example, where an international mailing is to be sorted by a system which handles only numeric characters, alpha-numeric postal codes for some countries may need to be remapped to for example a numeric code for the country before application to the sorting equipment. There are also applications where a variety of programmable data manipulations, configurable outsorting of mail items, or various types of selective sorting of mail may be required or otherwise desirable or where it is desirable to perform statistical modeling, trend analysis, frequency distribution or other analysis on mail items being sent. While some of the these functions can be performed at a main computer of the mailing organization before mail items are addressed and sorted for mailing, this does not provide information on mail items actually sent, and may therefore be less accurate than collecting information as the mail items are being sorted for delivery to the post office. Such a procedure also permits errors which have not been caught and corrected earlier in the system to still be corrected before the mailing goes out, for example to pick up a recently received change of address. Further, it would be desirable if such objectives could be accomplished without requiring any changes to existing sorting systems and without requiring reprogramming of the computers used to currently control such sort operations. None of the above capabilities currently exist.

While the various operations indicated above could be performed by receiving an entire postal code for each mail item, and then performing matches or other operations on each such received code in order to effect the desired purge/re-mapping function, current sorting systems for mail items operate at very high speed, for example approximately twelve mail items per second for an illustrative system, in order to permit optimum utilization of available sort equipment. It is important that any method and apparatus for accomplishing the various functions discussed above not have a significant adverse impact on system throughput. Since postal code characters are received in a typical sorting system one character at a time, a procedure which permits characters to be matched on as received, rather than waiting for the entire postal code to be read and received, could permit desired operations to be performed, and in many cases completed, while the characters are being received, thereby resulting in substantially no delay as a result of these operations, and could significantly reduce any delays resulting from operations which can only be completed after all characters are received, thereby permitting the various operations indicated above to be performed with negligible impact on system throughput. Similar problems can arise in other applications, for example some artificial intelligence applications, where data is received piecemeal, generally a character at a time, and particularly where decisions may need to be made before all data is received. However, existing techniques for storing ordered lists or for searching on such lists do not normally permit such searching to be performed, character by, character as, characters are being received. A need therefore exists for an improved ordered list storage and searching technique for facilitating such character-by-character searching.

SUMMARY OF THE INVENTION

In accordance with the above, this invention provides a method and apparatus for use in a system utilizing a sort processor to sort mail items based on an N character postal code read from each mail item by a code reader, the apparatus operating to facilitate the custom sorting, outsorting or other re-mapping of mail items from a mailing. The apparatus includes a memory storing a listing of postal codes for which mail items are, for example to be custom sorted or outsorted; and a processor to which outputs from the code reader are applied, the processor searching for matches between codes applied thereto and codes stored in the listing, passing selected outputs to the sort processor in response to matches found for selected mail items, and passing different selected outputs to the sort processor for mail items on which no match is found. Where no match is found, the postal code may for example be passed unaltered to the sort processor, while if a match is found, a defined value may be passed to the sort processor. The sort processor may respond to the defined value by outsorting the corresponding mail item. Alternatively, if no match is found, a defined value may be passed to the sort processor. The defined value may be a defined count value or a defined forced output value. A forced output value for each stored postal code may for example be stored in the list with the corresponding code. The sort processor may respond to a defined value by outsorting the corresponding mail item.

For other embodiments, if a match is found, a selected action is taken as a function of at least one stored condition. For example, the number of matches in a sort for a given stored postal code may be stored in the listing with the postal code, and the selected action for a given postal code may be taken as a function of the number of prior matches for such code. For a preferred embodiment, the postal code has a sufficient number of characters to uniquely identify individual address locations. In particular, the items to be custom sorted may be mail items to be purged from a mailing, the list containing, for example, 11-digit ZIP codes for such items, and the processor passing ZIP codes read by the processor to the sort processor when there is no match, and passing a defined ZIP code to the sort processor when there is a match, the defined ZIP code causing the sort processor to outsort the corresponding mail items. For another embodiment, the list contains all postal codes in the mailing and a count of the number of matches for each postal code. The processor increments the count for a postal code each time a match is found, and the processor causes outsorting of an item coded for a given postal code if the count for the postal code is at least a selected value. For one embodiment, the selected value is 1.

The stored list may be an ordered list of the N character postal codes, the code reader applying characters sequentially to the processor as read, and the processor matching on each subset of M of the characters as received, terminating the match attempt for an item when a match is not found at a point in the search, and passing a "no match" output to the sort processor for such items. Match attempts for a received subset for a given item are preferably performed starting at a point in the ordered list determined by matches on the prior received subset for the item. The ordered list preferably includes an N bit representation of each character of each entry, there being a node in the memory corresponding to each bit, and the bits of each entry being linked to form a tree. The processor converts characters outputted from the reader to the N bit representation and uses these bits to search in the tree until an empty node is found, signifying a mismatch, or an end of search indication is received.

For preferred embodiments, the postal codes are bar codes, and the code reader is a bar code reader (BCR), while for an alternative embodiment, the postal code is in optical character form, and the code reader is an optical character reader (OCR). Where the postal codes are N character bar codes and the list is an ordered list of N character bar codes, the code reader may apply the characters sequentially to the processor and the processor may match on each subset of M of the characters as received, terminate the match attempt for an item when a match is not found for a subset, and pass a "no match" output to the sort processor for such items.

The invention also includes, in a system for utilizing a sort processor to sort mail items based on an N digit postal code read from each item by a code reader, an apparatus for facilitating selective custom sorting of at least selected ones of the mail items, which apparatus includes a memory storing a list of postal codes for items to be custom sorted; and a processor to which code reader output characters are sequentially applied as read, the processor searching for matches between each subset of M of the digits of each incoming postal code as received and postal codes in the list, terminating match searching for a mail item when a match is not found at any point in the search for the item or when all desired characters have been searched and, on termination of match searching for an item, passing a selected output to the sort processor in response to a match being found and a different selected output to the sort processor in response to no match being found. For this aspect of the invention, match attempts for a received subset for a given mail item are preferably performed starting at a point in the ordered list determined by matches on the prior received subset for the item.

In accordance with still another aspect of the invention, a method and apparatus for remapping of mail items of a mailing are provided which include a memory storing a listing of postal codes for which remapping of mail items should be performed; and a control processor to which outputs from the code reader are applied, the control processor searching for matches between codes applied thereto and codes stored in the listing, passing selected outputs to the sort processor in response to matches found for selected mail items under selected conditions, and passing different selected outputs to the sort processor for mail items where (i) no matches are found and/or (ii) matches are found under different conditions. In the method and apparatus indicated above, the control processor can also be utilized to collect and/or report data on matches performed, perform statistical modeling, trend analysis, frequency distributions and/or other analysis on the mailing.

In accordance with still another aspect of the invention, a method and apparatus are provided for storing an ordered list of multicharacter entries in a memory device which includes converting each character of each entry into an N bit representation of the character by use of a suitable mechanism and which combines the N bit representations in a predetermined order to form an incremental ordered entry (IOE); and, starting at a selected node in the memory device, utilizing a suitable mechanism to look at a first bit of the IOE, branch to a node in a first direction if the bit is a zero, branch to a node in a second direction if the bit is a one, determine if an entry is stored at the node branched to and store a selected entry at the node branched to if it does not already contain an entry, this sequence of operations being repeated for each successive bit of the IOE, starting for each bit at the node branched to for the preceding bit of the IOE, until all bits of the IOE have been looked at. The predetermined order may, for example, be from most significant bit of the most significant character to least significant bit of the least significant character. The successive nodes for each IOE form a tree branch, at least selected nodes on each tree branch containing at least a representation of the IOE characters to that point in the tree branch. At least selected nodes may also contain data to be outputted in the event a search were to end at the node, and at least selected ones of the nodes may be shared by tree branches for at least two IOE entries.

A method and apparatus may also be provided for performing a search to determine if a multicharacter input received a character at a time matches in entry in an ordered list of multicharacter entries stored in a memory device in accordance with the method and apparatus indicated above. Such method and apparatus convert each character of the multicharacter input as received into an N bit representation of the character; and then utilize a suitable mechanism to look at the bits for the input characters in a predetermined order, M characters at a time, where M is an integer ≧1, starting at the selected node, and branching to a node in a first direction if the bit looked at is a zero, branching to a node in the second direction if the bit looked at is a one, continuing the branching for a successive bit if there is an entry at the node branched to, and generating a "no match" indication if there is no entry at the node branched to N bit representations of successive characters of the input being looked at until either a "no match" indication is generated or an end of search indication is received. Looking at bits for each M characters of the input after the first M characters preferably starts at the node at which looking for the last bit of the preceding M characters looked at ended. The end of search indication may, for example, be an end of entry input received at the end of the input entry or a signal generated by a suitable mechanism at a selected point of the input. In response to an end of search indication, suitable mechanisms may be provided for utilizing the entry at the last node branched to before the end of search indication to perform a selected control function.

The foregoing and other objects, features and advantages of the invention will be apparent from the following more particular description of preferred embodiments of the invention as illustrated in the accompanying drawings.

IN THE DRAWINGS

Figure 1:
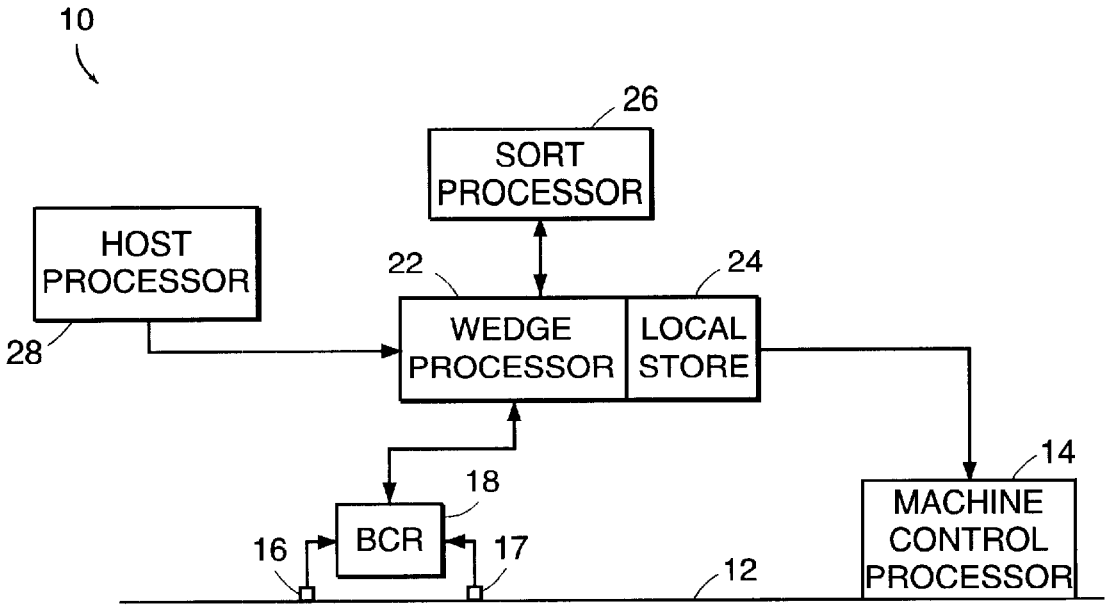
Figure 3:
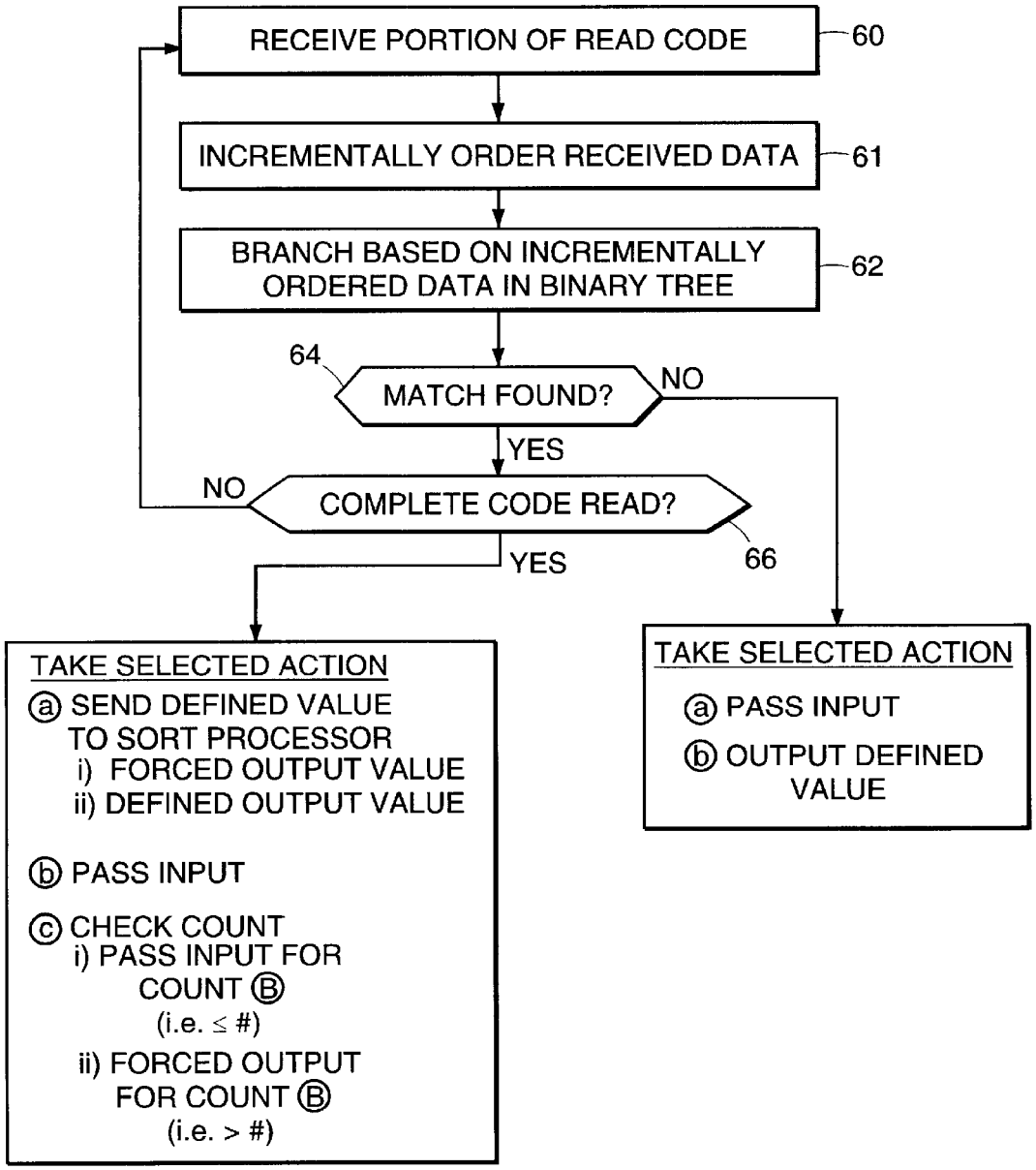

FIG. 1 is a block diagram of a mail item handling system suitable for use in practicing the teachings of this invention;

FIGS. 2*a*–2*e* are diagrams of an illustrative format for storing a local list for use in practicing the teachings of this invention, and of the forming and searching on an entry tree in accordance with the teachings of this invention;

FIG. 3 is a flow diagram illustrating operation of the wedge processor of FIG. 1 in accordance with the teachings of this invention for illustrative embodiments.

DETAILED DESCRIPTION

FIG. 1 illustrates a system for sorting mail items based on a postal code read therefrom. The mail items may include one or more of postcards, letters in envelopes of varying sizes, catalogs, magazines, and other publications, and packages of various sizes. The postal code would be the appropriate postal code for the country to which each mail item is being sent, the postal code being for example an eleven-digit ZIP code for the United States, and may be an alpha-numeric postal code for other countries. The postal code may have a sufficient number of characters/digits to uniquely identify an individual address location (i.e., an 11-digit ZIP code) and a postal code having such a number of digits is assumed for at least some of the following discussion.

In FIG. 1, the system 10 feeds mail items along a suitable conveyer 12 to a sort destination where the mail items are sorted under control of a machine control processor 14. The postal code may be recorded on the mail item as a sequence of optical characters and/or is frequently recorded on the mail item, particularly by mass mailers, in bar code. A suitable transducer, for example a photocell 16, triggers a reader device to scan each postal code character as it passes thereunder in a manner known in the art and transmits this information after receiving a second trigger 17. The reader may be a barcode reader (BCR) 18 as shown in FIG. 1, an optical code reader (OCR) or other suitable device for reading the postal code characters in the form in which they are recorded on the mail items. Since it is possible that, in mixed mail input, postal codes may be presented in more than one form, more than one reader may be provided to assure that the postal codes from all mail items are read. However, while the reading of the postal code from each mail item is critical in practicing the teachings of this invention, the specific manner in which such codes are read from each mail item is not part of this invention, and any of a variety of techniques for reading postal codes, either in bar code form, character form or other form, known in the art may be utilized in practicing the teachings of this invention.

Machine control processor 14 operates in response to inputs received from sort processor 26. Heretofore, outputs from character reader 18 have been applied directly to sort processor 26, resulting in suitable outputs to machine control 14 to cause each mail item to be properly sorted (i.e., to be directed to the appropriate bin for the postal code contained thereon). However, sort processor 26 for currently available systems are not capable of selectively outsorting mail items from a mailing which it has been determined, for whatever reason, should not be sent. In particular, current systems are not capable for identifying when the sending of a given mail item is no longer desirable or when multiple copies of a given mailing are being sent to a single recipient or to recipients at a single address and to prevent or limit the sending of such undesired items or multiple copies. More generally, processor 26 is not capable of re-mapping the sorting for a given mailing and/or otherwise performing a custom sort for a selected one or more runs. While it is possible that such a capability could, if desired, be added to sort processor 26, and it is within the contemplation of this invention that separate programs could be added to sort processor 26 in accordance with the teachings of this invention to be run in parallel with the sort routines currently being run on this processor in order to perform the various functions indicated above, it is currently considered preferable to provide a separate processor (hereinafter sometimes referred to as a "wedge processor") 22 for performing these functions. The primary reason for providing a secondary wedge processor is that, with perhaps over a million mail items being processed in a single run, it is desirable that conveyor 12 for the mail items run as rapidly as possible, and in particular that it take approximately 60–80 milliseconds to process each item, resulting in a throughput of approximately 12 items per second. With existing processors, such a throughput rate is better achieved for a preferred embodiment with a separate wedge processor 22 and sort processor 26, the wedge processor performing all of the customized sort functions indicated above on incoming postal code information received from code reader 18 and outputting information to sort processor 26 in a form such that the existence and operation of wedge processor 22 is transparent to the sort processor.

For preferred embodiments, wedge processor 22 has a local store or memory 24, which is preferably organized in the manner shown in FIG. 2. Information may be loaded into local store 24 through wedge processor 22 from a host processor 28 or from another suitable source, for example a local keyboard. Referring to FIG. 2*a*, an entry stored in local store 24 may for example contain three fields, an input data field 106, which contains postal codes to be matched on in a given run, an output/defined data field 113, which, if employed, contains a defined postal code which is to be substituted for the input postal code when a match is detected, and a count value field 114, which may for example be incremented or decremented each time there is a match on the postal code in the corresponding input data field or which may be otherwise utilized. Depending on application, the output field and/or the count value field may either contain different data than that indicated above or may be eliminated. For example, if the same defined value is outputted from wedge processor 22 when there is a match regardless of the postal code matched on, then the output data field is not required in store 24, the defined value being stored once, for example in a register, and being outputted each time a match is detected.

Memory 24 being loaded from a host processor 28 provides maximum flexibility, permitting memory 24 to be loaded with appropriate data for each mail item to be sorted, for example permitting status changes for a recipient at a given postal code received as recently as a few hours earlier to be entered so that mail items addressed to the corresponding recipient may be purged or otherwise custom sorted/remapped. Further, where different types of mail items are being run for different runs, requiring different types of custom sorting operations to be performed, host processor 28 may also modify at least the portion of wedge processor 22's programming which is utilized to control a given run so as to achieve a desired custom sorting for such run. For example, slight differences may be required when sorting mail only directed to the USA which contains numeric ZIP codes and when sorting international mailings which can include alpha-numeric postal codes. It is also possible for wedge processor 22 to perform two types of custom sorting during a single run. For example, all items for a given run could be listed and a count value field incremented each time there is a match on the corresponding postal code, with subsequent matches for such postal code being outsorted, and an extra bit could be provided in the input data field which is marked if items for the marked postal code are to be outsorted, regardless of the number of hits on that postal code. Thus, during a single run, both extra mail items to a given addressee and items sent to an improper addressee could be outsorted. This could, for example, assure that each subscriber to a publication receives only one copy of the publication and that copies are not sent to subscribers who have been recently terminated, either at the subscriber's request or involuntarily. It is also possible for wedge processor 22 to perform three types of custom sorting during a single run. It may be desirable to intentionally assure that a subscriber receive more than one publication and not outsort subsequent matches on the corresponding postal code. For example, a doctor's office that is occupied by several physicians and has several waiting areas may want more than one copy of a publication; however, the postal code on each publication would be the same. Wedge processor 22 could be provided in the count field with a number which is decrement each time there is a match on the corresponding postal code. If for example the count field were three, the wedge processor would decrement the count field to two on the first match of the corresponding postal code, decrement the count to one on the second match, and finally to zero on the third match. A count field value of zero for a match on a corresponding postal code would cause the publication to be purged. If only one mail item is desired for other addressees, the count field would simply be set to one. Thus, during a single run, multiple mail items to a single addressee could be controlled, extra mail items to a given addressee could be outsorted, and items sent to an improper addressee could be outsorted. This could, for example, assure that each subscriber to a publication receives multiple copies of the publication, or only one copy of the publication and that copies are not sent to other subscribers, or to non-subscribers whose postal codes would not appear on the list.

While some of the re-mapping functions being performed by wedge processor 22 are performed with the idea that each postal code is unique to an individual address location, for example an 11 digit ZIP code, this is not a requirement for the application to work. For example, to assure that no copies of a mailing reach a particular neighborhood, the input data field in local store 24 would contain only a nine-digit ZIP code instead of eleven or, as will be discussed later, matches could be performed only on the first nine digits of an 11-digit ZIP code. By outsorting all postal codes that contain the same first nine digits, a geographic area the size of a neighborhood is covered by a single input data entry. Further, if the input data field contained only five digits, all matches on the first five digits could be purged to assure that no mail pieces reach a certain city or region within a city. This is desirable for example, during time of natural disaster such as an earthquake or hurricane, when the post office has no way to receive or process mail. Those pieces could be outsorted and stored until delivery is possible.

FIG. 3, which is a flow diagram of the operation of wedge processor 22 for an illustrative embodiment, shows another feature of the invention. In particular, when head 18 reads barcode or optical code from a mail item passing thereunder, it reads the code one digit or character at a time, starting with the most significant digit of the code for illustrative embodiments. Thus, processor 22 receives the input postal code one digit at a time. While the system could wait until the entire postal code for a given item is received before performing a comparison, wedge processor 22 is capable of operating at much higher speed than the speed at which characters are read and delivered to the processor. Therefore, the speed of operation for the comparison function can be significantly enhanced if comparisons begin before all digits are received.

FIGS. 2(*a*)–2(*e*) diagram memory layout and an incremental lookup mechanism of wedge processor 22 for an illustrative embodiment. Input data (106), output data (113) and count value (114) are, for an illustrative embodiment, stored in the following way: if the length of the input data (106) has an odd number of digits, a zero is appended as the least significant digit of the number (see 107, FIG. 2(*b*)) to make the number of digits even. If the length of the input data has an even number of digits (106', FIG. 2*d*), the data is used unaltered (107'). The two most significant digits 108, 108' are then converted to a single eight bit number 110, 110', with the first most significant digit represented by the four most significant bits and the second digit represented by the four least significant bits. Then the next two most significant digits 109, 109' are converted to a single eight bit number 112, 112' and so on until all groups of digits have been converted into a single binary stream of bits 115, 115'. The binary stream of bits 115, 115 ' is used as a map to find a location in memory 24 to store the input data 106, and corresponding output data 113, 113' and count value 114, 114' by branching for example, left for zero and right for one in a binary tree structure. The technique of branching on binary digits as a map into memory is well known in computer science as a digital search; however the ordering of the binary digits by incrementally converting each input digit, from most significant character/digit/byte to least significant, and using the combined converted bits as the map is unique to this invention. This technique essentially orders the data in memory in such a way that it is stored as it will be looked up; that is to say it can be found incrementally as the data is received. Other binary search methods rely on a data value for example 1234, to be converted in whole to a binary value 000010011010010. This would assure a false lookup on anything less than the full number, thus making incremental lookups impossible. The incremental ordering of the data value for example 1234, would convert to binary 0001001000110100, thus allowing incremental lookups from the most significant digit of the data value to the least significant value.

Once the incremental ordering of the data 115, 115' has been completed, a binary tree is created in memory 24 for each entry. FIG. 2(*c*) illustrates the methodology for creating such a binary tree. The tree begins in each instance at a root location or node 130. From this node, and for each subsequent node, the tree branches in one direction for the next most significant bit being looked at if the bit is "0", this direction being indicated as left by way of illustration in the Figure, and branches to a node in a different direction, illustrated as right in the Figure, if the bit is a "1." Thus, the left-hand tree 128 in the Figure is an illustrative tree for the ordered data 115, while the right-hand tree 129 is an illustrative tree for the ordered data 115'. Each node is a memory location which for an illustrative embodiment contains 30 bytes. The node may for example store the input data for the tree up to the point where that node is located and may also contain an output data field and count value field relevant to that node. Other appropriate information may also be stored at each node to enable application specific variations on the invention. Further, while a separate tree 128, 129 could be formed for each item of ordered data 115, since there might be a million or more such items for a given mailing, and since for an illustrative embodiment each entry would have at least 11 bytes/characters, this would require an enormous amount of memory space. Fortunately, for purposes of comparing on incoming data to determine if the postal code for an incoming mail item matches an entry stored in the memory 24 list, it is not necessary to store a separate tree for each entry; and instead, when the entries 115 are being stored, an entry is made for a node only if an entry does not currently exist for that node. If an entry exists for the node, then nothing further is recorded at that node and the next node for the entry 115 for which the tree is being generated is looked at. If at any point in the generating of the tree for a given entry, a node is reached which does not already exist, a new node is created, including the recording of appropriate data for such node. Thus, node 131 which is reached after the first two bytes have been entered for ordered data 115 stores in its input data field the bytes "12". When the node 132 is reached in the creation of the tree 128, the data "123" is stored thereat. If the tree 128 were being created for an eleven byte ZIP code, the process of creating tree 128 would continue until nodes existed for all of the ordered bits for the 11 digits of the code. Similarly, for the tree 129, bytes "93" are stored as input data for node 134 and the data indicated at 136 is at least part of the data stored for node 135. Tree 129 could also be expanded to add additional bytes or characters as appropriate for the input data being recorded.

One advantage of forming the trees or tree branches in the manner indicated in FIG. 2(*c*) is that, as will be discussed in more detail shortly, each node contains data appropriate for that point in the tree, permitting a search to be cut off at any point in the tree, for example searching on only seven characters of an eleven character postal code, while still getting useful information when a match occurs.

Further, while in the discussion above it was assumed that the input code was only in digits, for example U.S. ZIP codes, that is not a limitation on the invention, and the invention could also be used with alpha-numeric input codes, such as the postal codes for the UK and many other countries. In this case, each character needs to be represented by at least six digits and, for an illustrative embodiment where data is stored in four bit bytes, each character would be represented by two four bit bytes or eight bits. For a mixed mail application which included both United States and international mail, all of the entries might be stored as eight bit characters for consistency and the tree structure would reflect this change.

Once all of the entries to be stored in memory 24 have been stored as trees/branches in the manner indicated above, the system is ready to perform matching on a mailing. As each mail item passes under code reader 18, characters are read from the mail item, starting with the most significant digit or character thereof. Each character is delivered to wedge processor 22 as read, and a search may begin on each character as received or when a selected number of characters have been received. For an illustrative embodiment, matching is performed two bytes (eight bits) at a time. Thus, the comparison is performed for one eight bit alpha-numeric character at a time, or two four bit digital characters at a time. FIG. 2 illustrates the search being done two four-bit digits at a time. A match search also beings at starting node 130 and proceeds either left or right depending on whether the bit of the two bytes being looked at, for example the bytes 110, 110', are a 1 or a 0, the search proceeding from most significant to least significant bit of the two bytes. So long as a node exists in local store 24 at the node branched to for a given bit, the search continues along the tree for the incoming two bytes. However, if at any point in the search a node is branched to for which there is not an existing node in local store 24, this means that there is no match for the incoming postal code and a no match indication is generated, eliminating the need for further searching. Thus, where the postal code of an incoming mail item is not stored in local store 24, a comparison does not need to be made on the entire incoming postal code and searching may be terminated as soon as the first character of the input postal code is received for which there is not a match, thereby significantly reducing required search time. Further, since comparisons on an incoming character or characters are being performed as the characters are being received, and such comparisons can normally be completed in the time between the receipt of new characters from character reader 18, the comparison operation does not introduce any significant delay.

If matching occurs on the first two characters 110, 110', then the next two characters 112, 112' are received and comparison is performed on these characters. However, this operation begins at the point in the tree, for example 131, 134, where matching on the first two characters terminated rather than at the beginning 130 of the tree. This further contributes to the speed of the search operation. If matching occurs on the first four characters, the next two characters would be received and looked at, the tree being entered at for example point 132, 135 at the end of the first four characters. This search pattern would be continued until either a null node was branched to, indicating a mismatch or an end of search indication was received. This process allows searching a very large tree incrementally between the reception of data bytes instead of waiting for the entire data to be received before searching begins. Thus, by starting with an incrementally ordered binary tree and performing the search in the manner indicated, searches for matches, even where the tree in local store 24 contains over a million entries, can be easily accomplished on a real-time basis.

One significant advantage of the search technique indicated above is that permits the search to be terminated at any point or node in the tree, and in particular at the end of any byte. Thus, while eleven digit ZIP codes may be looked at, in a particular application it may be desired to outsort all mail items which are directed to particular neighborhoods, or even particular cities, or to outsort all mail items which are not directed to such neighborhoods or cities, for example mail of a candidate for political office being directed only to areas within the district of the candidate. For such a sort, a decision could be made after six or seven digits of the ZIP code had been looked at. In this case, wedge processor 22 would provide an end of search output when six or seven digits had been matched on and the entry, 133, 136, at the final node of the tree for this search would be used to increment or decrement a count if required and/or to provide a directed output code for the mail item. The end of search indication may, for example, be a special data value generated by wedge processor 22, for example a value that cannot be converted into two distinct numbers, which would be any value greater than 99, or may be an end-of-stream character received from bar code reader 18 or other suitable end-of-code character. This capability of terminating the search at any character while still obtaining useful match/no match indications and appropriate outputs is a significant feature of the invention.

The operation of wedge processor 22 to perform matching is further illustrated in FIG. 3, the first step in the operation, step 60, being to receive characters from character reader 18, the data from the character reader coming in one character or byte at a time. The rate at which the characters are received varies as a function of the speed of mail item transport 12. For an illustrative embodiment, a character is received every 208 microseconds. When a selected number of such characters have been received at wedge processor 22, for example the two most significant digits for an illustrative embodiment, the operation proceeds to step 61 to incrementally order the bits of the received two digits and then to step 62, branching accordingly in the binary tree.

During step 64, a determination is made as to whether a match was found during step 62 between each ordered bit of the inputted two digits and the bits or nodes of the most significant two digits for one or more entries in the tree. If nodes exist for all bit branches of step 62, the operation proceeds from step 64 to step 66 to determine if all desired digits for the incoming postal code have been received, or in other words whether the complete input code has been read. If all desired digits of the incoming postal code have not been received, the operation returns to step 60. At this point, or very soon thereafter, the next byte (or two bytes) should have been received at processor 22. When this happens, the operation proceeds to steps 61 and 62 to order the received data and to branch based on the next bits of the received postal code in the tree. Again, since the tree is an incrementally ordered binary tree, the proper entry point for what can be well over a million entries in the tree can be determined and a determination can be made quickly as to whether matching entries are present at the point in the tree where they should exist, or whether there are no entries at this point in the tree. If during step 64 a determination is made that only four of the eleven digits of for example an eleven digit ZIP code had been looked at, the operation returns to step 60, where the next bytes should be substantially ready to be passed on for comparison.

The process indicated above of comparing on incoming bytes as they are received continues until either, during step 64, a determination is made that no match is found, or during step 66, a determination is made that nodes for all bits of the incoming postal code exist in the tree and the final node has data in it.

If a "yes" output is obtained during step 66, this means that a match has been found for the mail item being looked at in the tree stored in local store 24. Depending on the way in which processor 22 is programmed, or in other words the objective of the specialized sort operation, a "match" output may cause a variety of different results. For example, if the objective is to outsort a mail item having a matching postal code, for example a dunning letter or renewal notice which is no longer required to be sent, then wedge processor 22 may output a defined value, for example a defined value stored in the output/defined data field of the list for the corresponding matched-on entry, to sort processor 26. This defined value may for example be an invalid five-digit ZIP code which causes the corresponding mail item to be directed to a selected outsort location.

Alternatively, the system may be utilized to permit only items directed to codes contained in the list to be delivered, with all other items being outsorted. Thus, the list could contain the eleven-digit ZIP codes for current valid subscribers to a publication being mailed, the publication being passed to be mailed if addressed to one of these valid subscribers, and being outsorted if for example addressed to someone who is no longer a subscriber or to whom the publication is otherwise erroneously addressed.

Wedge processor 22 may also be utilized to perform a variety of re-mapping functions. For example, where an international mailing is being performed where incoming postal codes may contain alpha-numeric characters, while machine control processor 14 is only designed to respond to numeric characters, as is the case for many such machines, wedge processor 22 could be utilized to recognize received alpha-numeric postal codes and to re-map such codes by providing a directed output for each which is a fully numeric code recognizable and usable by machine control processor 14. Similarly, where the system is being used to recognize part codes on parts rather than mail items being moved on transport 12, which parts are to be sorted to storage bins, the directed value for each matched on part code could be the appropriate bin number. Other re-mappings for postal or other received codes are also possible.

The count value field may also come into play when a match is detected. For example, each time a match is detected, the value in the count value field may be incremented or decremented by one. When a match is detected, the program may look at the count value field, and if this value is equal to and/or greater than some selected value, or equal to and/or less than some selected value, some action may be taken which is dictated by the processor programming. For example, to avoid sending multiple copies of the same mailing to a given individual or residence, Wedge processor 22 may output a selected invalid ZIP code which results in an outsorting of the corresponding mail item when a match occurs for the item and the value in the count field is one or greater. The number at which the forced output occurs for a given item may also be either stored in the list for the corresponding entry or may be otherwise programmably determined in processor 22 for a given item. Numerous other options exist for custom sorting based on a received postal code read from the mail item being passed and a selected search criteria determined by the programming of processor 22.

Similarly, if no match is found during step 64, either for the most significant bytes, or for each bit thereafter, a variety of selected actions may be taken. For example, where matched items are to be outsorted, when no match is found, the input when fully present at processor 22, or on a byte by byte basis as received, may be passed directly to sort processor 26. In this case, the delay introduced by the presence of processor 22 may be as little as 10 microseconds for an illustrative embodiment.

Conversely, where only matched-on items are to be mailed, a defined value resulting in an outsorting of the unmatched item may be passed to sort processor 26 when no match is found. This value may for example be the same for all mail items which are not matched on, may for example be an invalid postal code, and may be stored for example in an appropriate register in processor 22. Other options may also exist where a no-match output is obtained depending on the custom sort objective to be obtained and on the programming of processor 22.

Once a code has been sent from wedge processor 22 to sort processor 26, sort processor 26 operates in standard fashion to utilize such code, whether a directly transmitted or pass-through postal code, or a defined value in the form of an invalid postal code, or postal code other than that read from the mail item, in the same way the sort processor currently utilizes postal codes applied thereto to control the operation of machine control processor 14, causing each mail item to be properly directed, including mail items to be directed to an outsort location. Since comparisons in processor 22 can generally be completed while characters are being read from the mail item, and in any event no more than one comparison on a very reduced list of entries (i.e. portions of the tree) must be made after all characters have been read from the mail item, the process of this invention introduces minimal delay in the receipt of real or pseudo postal codes by sort processor 26, this delay varying from a minimum of approximately 10 microseconds and no more than one millisecond for an illustrative embodiment. The use of an ordered list and the searching on pairs of inputted characters as received, can keep the delay to substantially the 10 microseconds range when no match is found and can reduce the delay where a match is found by roughly 30 to 50 microseconds for an illustrative embodiment, or roughly ¼ or ⅓ the delay which would occur if this technique was not used. The delay is further reduced by having a high speed bus between processors 22 and 26, for example a 110 kbaud bus, as opposed to a 38 kbaud bus normally utilized for the application of outputted characters from code reader 18. Further, in addition to controlling the selective sorting and re-mapping of mail items based on postal code, wedge processor 22 may also be utilized to produce reports and other information on what it is doing, for example indicating the number of copies for a given mailing which are addressed to the same postal code, which reports contain information that can be used for statistical, remedial or other purposes. Where custom sorting is not required, the wedge processor may function in an "off" mode where it merely passes characters received from code reader 18 directly to sort processor 26 with perhaps a 10-microsecond delay.

While the invention has been shown and described above with reference to a preferred embodiment, and variations on such preferred embodiment have been discussed, including processors 22 and 26 being subroutines running on the same processor, assuming the processor has sufficient speed and capacity, other variations are also possible. For example, wedge processor 22 and/or sort processor 26 may be a special purpose device or hybrid device for performing the indicated function. Further, while the conversion of the entries to be compared on into ordered entries which are then stored as a digital tree with relevant information stored at all nodes, or at least at the last node of each character, and the conversion of input entries into ordered entries a character at a time and the manner of searching, comparing the characters of the input, M characters at a time, as received, with the ordered list and the ability to end the search, with a meaningful output, after any character of the input have all been described with respect to a postal code application, these features are not limited to such applications, and could be used in any application where input characters to be compared on are received a character at a time; for example the parts storage applications discussed earlier. Thus, while the invention has been particularly shown and described above with respect to a preferred embodiment, the foregoing and other changes in form and detail may be made therein by one skilled in the art without departing from the spirit and scope of the invention which is to be defined only by the appended claims.

What is claimed:

1. In a system utilizing a sort processor to sort mail items based on an N character postal code read from each mail item by a code reader, an apparatus for facilitating the custom sorting of at least selected mail items of a mailing including:

a memory storing a listing of postal codes for mail items to be custom sorted; and a processor to which outputs from the code reader are applied, said processor searching for matches between codes applied thereto and codes stored in said listing, passing selected outputs to said sort processor in response to matches found for selected mail items, and passing different selected outputs to the sort processor for mail items on which no match is found.

2. Apparatus as claimed in claim 1 wherein, if no match is found, the postal code is passed unaltered to the sort processor.

3. Apparatus as claimed in claim 2 wherein, if a match is found, a defined value is passed to the sort processor.

4. Apparatus as claimed in claim 3 wherein said custom sorting is an outsorting of mail items having postal codes in said listing, and wherein said sort processor responds to said defined value by outsorting the corresponding mail item.

5. Apparatus as claimed in claim 1 wherein, if no match is found, a defined value is passed to the sort processor.

6. Apparatus as claimed in claim 1 wherein, if a match is found, a defined value is passed to the sort processor.

7. Apparatus as claimed in claim 6 wherein said defined value is one of a defined count value and a defined forced output value.

8. Apparatus as claimed in claim 7 wherein the forced output value for each stored postal code is stored in said listing with the corresponding code.

9. Apparatus as claimed in claim 6 wherein said custom sorting is an outsorting of mail items having postal codes in said listing, and wherein said sort processor responds to said defined value by outsorting the corresponding mail item.

10. Apparatus as claimed in claim 1 wherein, if a match is found, a selected action is taken as a function of at least one stored condition.

11. Apparatus as claimed in claim 10 wherein the number of matches in a sort for a given stored postal code is stored in said listing with the postal code, said selected action for a given postal code being taken as a function of the number of prior matches for such code.

12. Apparatus as claimed in claim 1 wherein said postal code has a sufficient number of characters to uniquely identify individual address locations.

13. Apparatus as claimed in claim 12 wherein said items to be custom sorted are mail items to be purged from a mailing, said processor passing postal codes received by said processor to said sort processor when there is no match, and passing a defined postal code to said sort processor when there is a match, the defined postal code causing said sort processor to outsort corresponding mail items.

14. Apparatus as claimed in claim 12 wherein said postal codes are 11-digit ZIP codes.

15. Apparatus as claimed in claim 1 wherein said listing contains all postal codes in the mailing and a count of the number of matches for each postal code, wherein said processor increments the count for a postal code each time a match is found, and wherein said processor causes outsorting of an item coded for a given postal code if the count for the postal code is at least a selected value.

16. Apparatus as claimed in claim 15 wherein said selected value is one.

17. Apparatus as claimed in claim 1 wherein said list is an ordered list of said N character postal codes, said code reader apply the characters sequentially to said processor, and wherein said processor matches on each subset of M of the characters as received, terminates the match attempt for an item when a match is not found for a character, and passes a "no match" output to the sort processor for such items.

18. Apparatus as claimed in claim 17 wherein match attempts for a received subset for a given item are performed starting at a point in said ordered list determined by matches on the prior received subset for the item.

19. Apparatus as claimed in claim 17 wherein said ordered list includes an N bit representation of each character of each entry, there being a node in said memory corresponding to each said bit, the bits of each entry being linked to form a tree, said processor converting characters outputted from said reader to said N bit representation and using said bits to search in said tree until an empty node is found, signifying a mismatch, or an end of search indication is received.

20. Apparatus as claimed in claim 1 wherein said postal codes are bar codes, and wherein said code reader is a bar code reader.

21. Apparatus as claimed in claim 1 wherein said postal code is in optical character form, and wherein said code reader is an optical character reader (OCR).

22. Apparatus as claimed in claim 1 wherein said processor passes codes for which no match is found to said sort processor, and passes a directed code to the sort processor when a match is found, the sort processor causing an outsorting of a mail item for which it receives the directed code.

23. Apparatus as claimed in claim 1 wherein said postal codes are N character bar codes, wherein said list is an ordered list of said N character bar codes, said code reader apply the characters sequentially to said processor, and wherein said processor matches on each subset of M of the characters as received, terminates the match attempt for an item when a match is not found for a subset, and passes a "no match" output to the sort processor for such items.

24. In a system for utilizing a sort processor to sort mail items based on an N character postal code read from each item by a code reader, an apparatus for facilitating selective custom sorting of at least selected ones of the mail items including:

a memory storing a listing of postal codes for items to be custom sorted; and a processor to which code reader output characters are sequentially applied as read, said processor searching for matches between each subset of M of the characters of each incoming postal code as received and postal codes in said listing, terminating match searching for a mail item when a match is not found for a subset for the item, and, on termination of match searching for an item, passing a selected output to said sort processor in response to a match being found and a different selected output to the sort processor in response to no match being found.

25. Apparatus as claimed in claim 24 wherein match attempts for a received subset for a given mail item are performed starting at a point in said ordered list determined by matches on the prior received subset for the item.

26. In a system utilizing a sort processor to sort mail items based on an N character postal code read from each mail item by a code reader, an apparatus for remapping of mail items of a mailing including:

a memory storing a listing of postal codes for which remapping of mail items should be performed; and a processor to which outputs from the code reader are applied, the processor searching for matches between codes applied thereto and codes stored in said listing, passing selected outputs to the sort processor in response to matches found for selected mail items under selected conditions, and passing different selected outputs to the sort processor for mail items where at least one of (i) no matches are found and (ii) matches are found under different conditions.

27. In a system utilizing a sort processor to sort mail items based on an N character postal code read from each mail item by a code reader, a method for facilitating the remapping of mail items for a mailing including:

storing a listing of postal codes for which remapping is to occur;

applying outputs from the code reader to a control processor;

utilizing the control processor to search for matches between codes applied thereto and codes stored in the listing;

passing selected outputs to the sort processor in response to matches found for selected mail items under selected conditions; and passing different selected outputs to the sort processor for mail items where at least one of (i) no matches are found and (ii) matches are found under different selected conditions.

28. A method as claimed in claim 27 including utilizing said control processor to at least one of collect and report data on matches performed, perform statistical modeling, trend analysis, frequency distributions and other analysis on the mailing.

29. In a system utilizing a sort processor to sort mail items based on an N character postal code read from each mail item by a code reader, a method for facilitating the custom sorting of at least selected mail items of a mailing including the steps of:

storing a listing of postal codes for which mail items are to be custom sorted;

applying outputs from the code reader to a processor;

utilizing said processor to search for matches between codes applied thereto and codes stored in said listing;

passing selected outputs to said sort processor in response to matches found for selected mail items; and passing different selected outputs to the sort processor for mail items on which no match is found;

at least one of said selected outputs resulting in custom sorting of corresponding mail items.

30. A method as claimed in claim 29 wherein, if no match is found, the postal code is passed unaltered to the sort processor.

31. A method as claimed in claim 30 wherein, if a match is found, a defined value is passed to the sort processor.

32. A method as claimed in claim 31 wherein said custom sorting is an outsorting of mail items having postal codes in said listing, and wherein said sort processor responds to said defined value by outsorting the corresponding mail item.

33. A method as claimed in claim 29 wherein, if no match is found, a defined value is passed to the sort processor.

34. A method as claimed in claim 29 wherein, if a match is found, a defined value is passed to the sort processor.

35. A method as claimed in claim 34 wherein said defined value is one of a defined count value and a defined forced output value.

36. A method as claimed in claim 35 wherein the forced output value for each stored postal code is stored in said listing with the corresponding code.

37. A method as claimed in claim 34 wherein said custom sorting is an outsorting of mail items having postal codes in said listing, and wherein said sort processor responds to said defined value by outsorting the corresponding mail item.

38. A method as claimed in claim 29 wherein, if a match is found, a selected action is taken as a function of at least one stored condition.

39. A method as claimed in claim 38 wherein the number of matches in a sort for a given stored postal code is stored in said listing with the postal code, said selected action for a given postal code being taken as a function of the number of prior matches for such code.

40. A method as claimed in claim 29 wherein said postal code has a sufficient number of characters to uniquely identify individual address locations.

41. A method as claimed in claim 40 wherein said items to be custom sorted are mail items to be purged from a mailing, said processor passing postal codes received by said processor to said sort processor when there is no match, and passing a defined postal code to said sort processor when there is a match, the defined postal code causing said sort processor to outsort corresponding mail items.

42. A method as claimed in claim 40 wherein said postal codes are 11-digit ZIP codes.

43. A method as claimed in claim 29 wherein said listing contains all postal codes in the mailing and a count of the number of matches for each postal code, wherein said processor increments the count for a postal code each time a match is found, and wherein said processor causes outsorting of an item coded for a given postal code if the count for the postal code is at least a selected value.

44. A method as claimed in claim 43 wherein said selected value is one.

45. A method as claimed in claim 29 wherein said list is an ordered list of said N character postal codes, said code reader apply the characters sequentially to said processor, and wherein said processor matches on each subset of M of the characters as received, terminates the match attempt for an item when a match is not found for a character, and passes a "no match" output to the sort processor for such items.

46. A method as claimed in claim 45 wherein match attempts for a received subset for a given item are performed starting at a point in said ordered list determined by matches on the prior received subset for the item.

47. A method as claimed in claim 45 wherein said ordered list includes an N bit representation of each character of each entry, there being a node in said memory corresponding to each said bit, the bits of each entry being linked to form a tree, said processor converting characters outputted from said reader to said N bit representation and using said bits to search in said tree until an empty node is found, signifying a mismatch, or an end of search indication is received.

48. A method as claimed in claim 29 wherein said processor passes codes for which no match is found to said sort processor, and passes a directed code to the sort processor when a match is found, the sort processor causing an outsorting of a mail item for which it receives the directed code.

49. A method as claimed in claim 29 wherein said postal codes are N character bar codes, wherein said list is an ordered list of said N character codes, said code reader apply the characters sequentially to said processor, and wherein said processor matches on each subset of M of the characters as received, terminates the match attempt for an item when a match is not found for a subset, and passes a "no match" output to the sort processor for such items.

50. An apparatus for storing an ordered list of multicharacter entries in a memory device including:

a first mechanism which converts each character of each entry into an N bit representation of the character and which combines said N bit representations in a predetermined order to form an incremental ordered entry (IOE); and a second mechanism which starts at a selected node in said memory device, looks at a first bit of said IOE, branches to a node in a first direction if said bit is a zero, branches to a node in a second direction if the bit is a one, determines if an entry is stored at the node branched to, and stores a selected entry at the node branched to if it does not already contain an entry, said second mechanism repeating the sequence of for each successive bit of said IOE, starting for each bit at the node branched to for the preceding bit of the IOE, until all bits of the IOE have been looked at.

51. Apparatus as claimed in claim 50 wherein said predetermined order is from most-significant bit of the most significant character to least significant bit of the least significant character.

52. Apparatus as claimed in claim 50 wherein the successive nodes for each IOE form a tree branch, at least selected nodes on each tree branch containing at least a representation of the IOE characters to that point in the tree branch.

53. Apparatus as claimed in claim 52 wherein said at least selected nodes also contain data to be outputted in the event a search were to end at the node.

54. Apparatus as claimed in claim 52 wherein at least selected said nodes are shared by tree branches for at least two IOE entries.

55. An apparatus for performing a search to determine if a multicharacter input received a character at a time matches an entry in an ordered list of multicharacter entries stored in a memory device by the apparatus of claim 50 including:

a first mechanism which converts each character of the multicharacter input as received into an N bit representation of the character; and a second mechanism which looks at the bits for the input characters in said predetermined order M characters at a time, where M is an integer $\geqq 1$, starting at said selected node, and branching to a node in the first direction if the bit looked at is a zero, branching to a node in the second direction if the bit looked at is a one, continuing the branching for a successive bit if there is an entry at the node branched to, and generating a "no-match" indication if there is no entry at a node branched to, N bit representations of successive characters of the input being looked at until one of a "no match" indication is generated and an end of search indication is received.

56. An apparatus as claimed in claim 55 wherein said second mechanism begins looking at bits for each M characters of the input after the first M characters starting at the node at which looking for the last bit of the preceding M characters looked at ended.

57. Apparatus as claimed in claim 55 wherein said end of search indication is at least one of an end of entry input received at the end of an input entry and a signal generated at said apparatus at a selected point of the input.

58. Apparatus as claimed in claim 55 including a third mechanism operative in response to an end of search indication for utilizing the entry at the last node branched to before the end of search indication to perform a selected control function.

59. A method for storing an ordered list of multicharacter entries in a memory device including:

a) converting each character of each entry into an N bit representation of the character;

b) combining said N bit representations in a predetermined order to form an incremental ordered entry (IOE);

c) starting at a selected node in said memory device, looking at a first bit of said IOE;

d) branching to a node in a first direction if said bit is a zero;

e) branching to a node in a second direction if the bit is a one;

f) determining if an entry is stored at the node branched to;

g) storing a selected entry at the node branched to if it does not already contain an entry; and h) repeating steps (c)–(g) for each successive bit of said IOE, starting for each bit at the node branched to for the preceding bit of the IOE, until all bits of the IOE have been looked at.

60. A method as claimed in claim 59 wherein said predetermined order is from most-significant bit of the most significant character to least significant bit of the least significant character.

61. A method as claimed in claim 59 wherein the successive nodes for each IOE form a tree branch, at least selected nodes on each tree branch containing at least a representation of the IOE characters to that point in the tree branch.

62. A method as claimed in claim 61 wherein said at least selected nodes also contain data to be outputted in the event a search were to end at said node.

63. A method as claimed in claim 61 wherein at least selected said nodes are shared by tree branches for at least two IOE entries.

64. A method for performing a search to determine if a multicharacter input received a character at a time matches an entry in an ordered list of multicharacter entries stored in a memory device by the method of claim 59 including:

a) converting each character of the multicharacter input as received into an N bit representation of the character, said converting being performed as characters of the input are being received;

b) looking at bits for the input characters in said predetermined order M characters at a time, where M is an integer $\geqq 1$, starting at said selected node;

c) branching to a node in the first direction if the bit looked at is a zero;

d) branching to a node in the second direction if the bit looked at is a one;

e) continuing the branching for a successive bit if there is an entry at the node branched to; and f) generating a "no-match" indication if there is no entry at a node branched to;

steps (c)–(f) being repeated for N bit representations of successive characters of the input being looked at until one of a "no match" indication is generated and an end of search indication is received.

65. A method as claimed in claim 64 wherein during step (b), the looking at bits for each M characters of the input after the first M character starts at the node at which looking for the last bit of the preceding M characters looked at ended.

66. A method as claimed in claim 64 wherein said end of search indication is at least one of an end of entry input received at the end of an input entry and a signal generated by a suitable control at a selected point of the input.

67. A method as claimed in claim 64 including utilizing the entry at the last node branched to before receipt of an end of search indication to perform a selected control function.

* * * * *